United States Patent [19]

Sachleben et al.

[11] Patent Number: 4,480,805

[45] Date of Patent: Nov. 6, 1984

[54] TRAVERSE YARN GUIDE

[75] Inventors: Harold G. Sachleben, Bellmawr, N.J.; Theodore A. Rayman, Chester, Va.

[73] Assignee: Allied Corporation, Morris Township, Morris County, N.J.

[21] Appl. No.: 474,660

[22] Filed: Mar. 11, 1983

[51] Int. Cl.[3] ..... B65H 57/28

[52] U.S. Cl. ..... 242/157 R; 242/43 R; 242/158.3

[58] Field of Search ..... 242/157 R, 43 R, 158.3, 242/158.5

[56] References Cited

U.S. PATENT DOCUMENTS

| | | | |
|---|---|---|---|
| 3,353,760 | 11/1967 | Brehm | 242/43 R |
| 3,502,282 | 3/1970 | Graf | 242/157 R |
| 3,664,596 | 5/1972 | Lenk | 242/43 R |
| 3,706,420 | 12/1972 | Lapidas et al. | 242/43 R |
| 3,836,087 | 9/1974 | Tschentscher | 242/43 R |
| 3,940,075 | 2/1976 | Lenk | 242/43 R X |
| 3,984,062 | 10/1976 | Robinson | 242/158.3 X |
| 4,007,885 | 2/1977 | Hare et al. | 242/43 R |

*Primary Examiner*—Stanley N. Gilreath

[57] ABSTRACT

A traverse yarn guide is provided for use with a winder which includes a cam, a cam groove and a guide slot. The guide comprises a metal guard plate, partially embedded in a body of synthetic material, the body having attached thereto a yarn guide of wear resistant material. The guard plate projects from the body on either side of the yarn guide to prevent yarn to body contact during yarn stringup. The body comprises at least one flange for retention of the body in a guide slot and a depression in which is inserted for pivotal movement a partially sheathed end of a shoe, made of synthetic material. The sheath is made of metal and rotationally attached to the shoe. The other end of the shoe is shaped to follow a cam groove and has a width of at most 0.457 cm.

6 Claims, 4 Drawing Figures

TRAVERSE YARN GUIDE

BACKGROUND OF THE INVENTION

1. Field of the Invention

The present invention relates to a traverse yarn guide. More particularly, the present invention relates to a traverse yarn guide for use with a continuous filament winder which includes a cam, a cam groove and a guide slot.

2. The Prior Art

Prior art traverse yarn guides are typically reciprocated in a guide slot, parallel to a cam and the building yarn package, by a shoe which follows the helical cam grooves in the rotating cam. With one-piece traverse yarn guides, the entire yarn guide twists to follow the cam groove for each cycle; the actual yarn guiding piece or eyelet turns on the yarn being traversed and causes excessive yarn damage. It is therefore advantageous to provide a pivot joint between the follower and the other, linearly reciprocating parts of the traverse yarn guide. See U.S. Pat. Nos. 3,664,596 to Lenk, 3,706,420 to Lapidas et al., 3,836,087 to Tschentscher and 3,940,075 to Lenk, all of which are hereby incorporated by reference. As discussed in the Tschentscher patent, relatively long delays by the guide in the vicinity of turnarounds causes undesirable buildup of yarn on the ends of the package. Long delays are created by cam grooves of greater than 0.476 cm (0.188 inch) width. The cam follower (or shoe), of necessity, must have a width smaller than the groove; cam followers which are made of molded plastic and rotationally receive a portion of the linearly traversing body (i.e., with the pivot function within the follower) are particularly susceptible to breakage. Space constraints, i.e., between the cam and the guide slot, may foreclose use of a pivot joint therebetween.

Most prior art traverse yarn guides are devices made of either metal with a carbide slot for the yarn or molded plastic with a ceramic eyelet. The disadvantages of the former are outlined in the Lapidas et al. patent. In the latter, designs wherein the molded plastic portion of the guide first presents itself to the yarn are quickly grooved by the yarn during stringup and thus destroyed.

The present invention has been developed to overcome these prior art problems. Other U.S. patents of interest are U.S. Pat. Nos. 3,502,282 to Graf and 3,984,062 to Robinson, both of which are hereby incorporated by reference.

SUMMARY OF THE INVENTION

The present invention provides a traverse yarn guide for use with a winder which includes a cam, a cam groove and a guide slot. The guide comprises a metal guard plate, partially embedded in a body of synthetic material, a yarn guide of wear resistant material, preferably ceramic, attached to the body, and a shoe made of synthetic material. The guard plate projects from the body on either side of the yarn guide to prevent yarn to body contact during yarn stringup. The body has at least one flange for retention of the body in a guide slot, preferably two flanges on opposite sides of the body. The body also has a depression into which is inserted for pivotal movement an end of the shoe. It is preferred that this end of the shoe be at least partially sheathed, the sheath being made of metal and rotationally attached to the shoe. The other end of the shoe is shaped to follow the cam groove and has a width of at most 0.457 cm (0.180 inch), preferably 0.279 to 0.457 cm (0.110 to 0.180 inch).

DESCRIPTION OF THE PREFERRED EMBODIMENT

In the accompanying drawings like numbers indicate like apparatus.

The winding device forms no part of the present invention; for more detail on such apparatus, reference may be had to U.S. Pat. No. 3,836,087 to Tschentscher which shows a typical cam, cam groove and guide slot arrangement.

Figure 1:
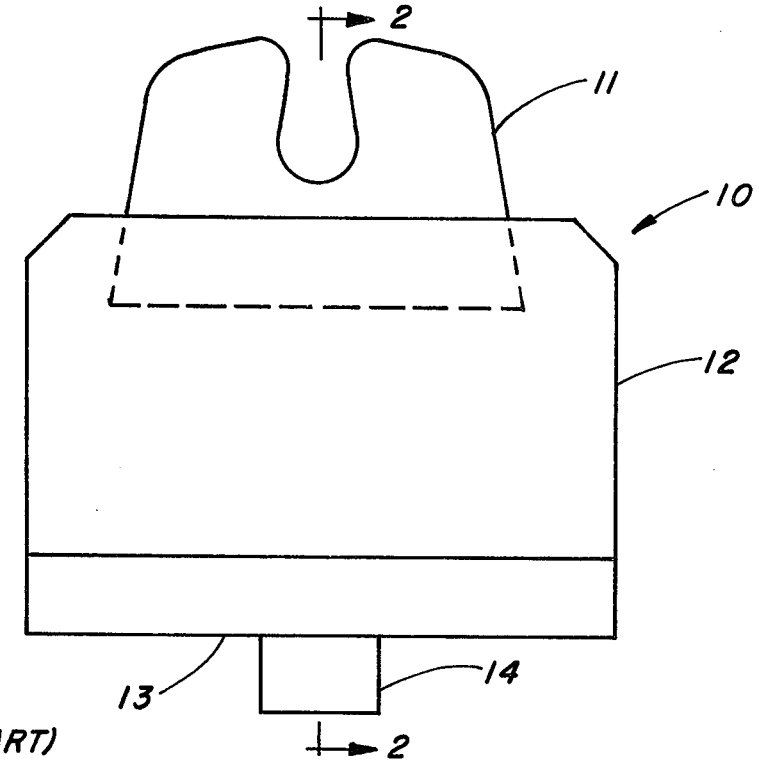
FIG. 1 (PRIOR ART)
FIG. 1 is a plan view of a traverse yarn guide of the prior art and FIG. 2 is a sectional view taken on lines 2—2 of FIG. 1.
Figure 2:
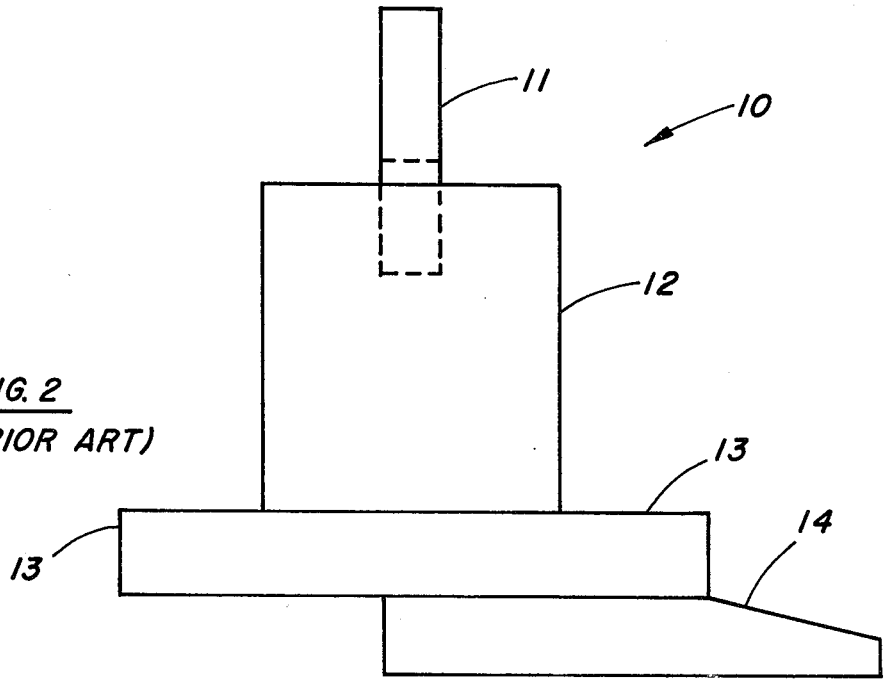
FIG. 2 (PRIOR ART)

FIGS. 1 and 2 depict a traverse yarn guide 10 of the prior art. Ceramic eyelet or guide piece 11 is embedded in body 12 of high impact moldable nylon plastic. Body 12 includes flanges 13 for retention in a guide slot (unshown) and follower shoe 14 which follows a cam groove in a cam (both unshown). Guide 10 twists to follow the cam groove for each cycle, thereby turning eyelet 11 on the yarn being traversed.

Figure 3:
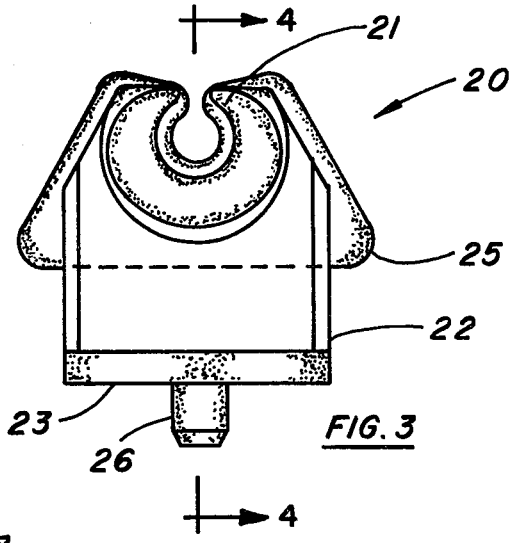
FIG. 3 is a plan view of a traverse yarn guide of the present invention.
Figure 4:
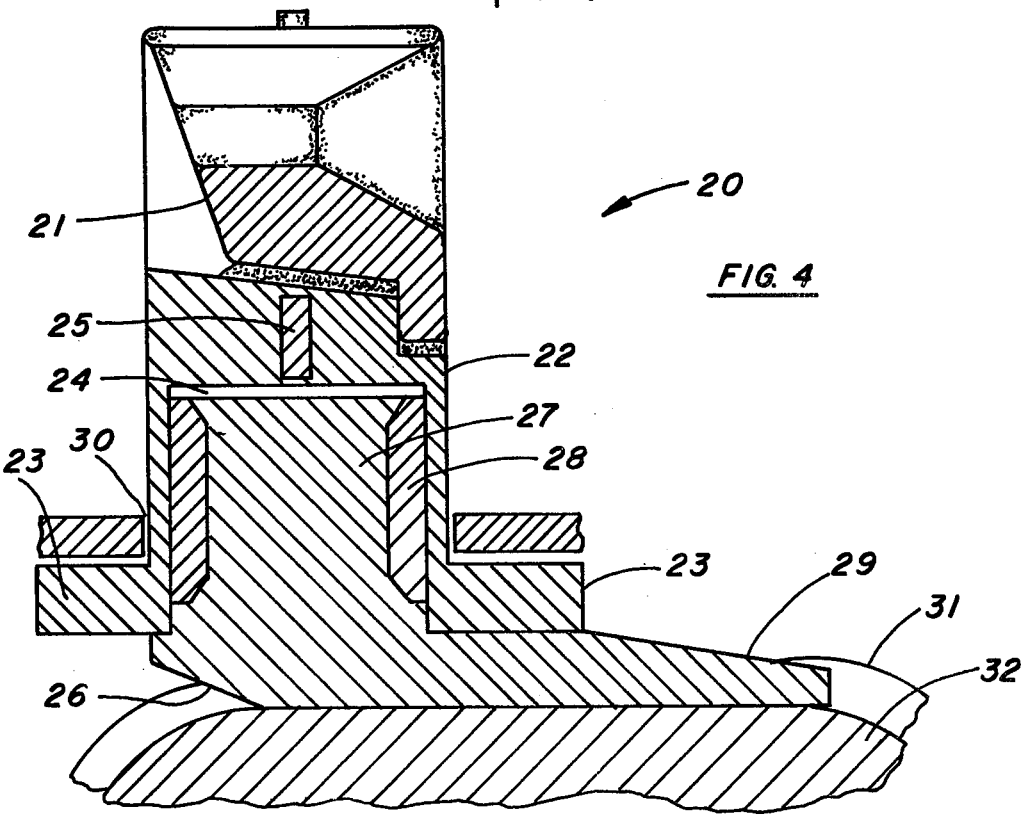
FIG. 4 is a sectional view taken on lines 4—4 of FIG. 3.

In FIGS. 3 and 4, traverse yarn guide 20 comprises guard plate 25 partially embedded in body 22, to which eyelet or guide 21 is attached. With reference to FIG. 3, guard plate 25 projects from body 22 on either side of guide 21. Body 22 additionally comprises two flanges 23, one on either side of body 22 (FIG. 4), although a single circular flange would function just as well in retaining body 22 in guide slot 30. Body 22 has depression 24 into which is inserted for pivotal movement one end 27 of shoe 26. End 27 is partially sheathed with metal ring 28, chamfered onto end 27 to prevent its sliding off, but capable of rotational movement around end 27. The other end 29 of shoe 26 is shaped to follow cam 32 groove 31 and has a width of at most 0.457 cm, preferably 0.279 to 0.457 cm.

Preferred materials of construction are as follows. Body 22 and shoe 26 are made of high impact, nonlubricant-type plastic such as molded nylon of Capron® 8252 nylon resin (Allied Corporation). Metal guard piece 25 is a noncorrosive, nonmagnetic stainless steel, such as 17-7PH, hardened by heating for an hour at 510° C. (950° F.). Metal ring 28 should be made of a noncorrosive metal due to its thinness. Brass or stainless steel, preferably the latter, are suitable. Eyelet 21 may be made of any wear resistant material such as ceramic. A thin coat of adhesive is applied to body 22, and eyelet 21 is assembled therewith, followed by heating for one hour at 93° C. (200° F.).

Metal ring 28 maintains the integrity of, and thereby protects, nylon end 27 of shoe 26. End 27 turns freely in depression 24 which keeps eyelet 21 from turning on yarn being traversed during operation. It is not feasible to design body 22 and shoe 26 so that the pivot function would be in shoe 26 due to the very narrow width of shoe 26 combined with its nylon plastic composition. Guard piece 25 protects body 22 from the abrasive effects of the yarn end during stringup. Body 22 does not turn during operation as it is wider in one dimension than the other, flanges 23 riding beneath the traverse guide slot 30. It can be seen that between flanges 23 and the groove 31 into which end 29 of shoe 26 would fit is insufficient space to provide a pivot joint. In the preferred embodiment depicted in FIG. 4, eyelet 21 is shown with a large sloping entrance and long yarn support to give maximum protection to the processing yarn.

We claim:

1. A traverse yarn guide for use with a winder which includes a cam, a groove in said cam, and a guide slot substantially parallel to the axis of said cam, said guide comprising:

a. a body of synthetic material, said body having
   (1) at least one flange for retention of the body in a guide slot, and
   (2) a depression;

b. a shoe having an end made of synthetic material for pivotal movement into said depression, the other end of the shoe being shaped to follow a groove in a cam and having a width of at most 0.457 cm;

c. a yarn guide of wear resistant material attached to said body and separated from said depression; and d. a metal guard plate, partially embedded in and projecting from said body on either side of said yarn guide to prevent yarn to body contact during yarn stringup.

2. The traverse yarn guide of claim 1 further comprising a metal sheath, partially sheathing the end of the shoe inserted into the depression for pivotal movement, said sheath being rotationally attached to the end of said shoe.

3. The traverse yarn guide of claim 1 wherein the body has two of said flanges, one on either side thereof.

4. The traverse yarn guide of claim 1 wherein the wear resistant material is ceramic and the body has two of said flanges, one on either side thereof, and wherein the guide further comprises a metal sheath rotationally attached to and partially sheathing the end of the shoe, the other end of the shoe having a width of about 0.279 to 0.457 cm.

5. The traverse yarn guide of claim 1 wherein the wear resistant material is ceramic.

6. The traverse yarn guide of claim 1 wherein the other end of the shoe has a width of about 0.279 to 0.457 cm.

* * * * *

UNITED STATES PATENT AND TRADEMARK OFFICE

CERTIFICATE OF CORRECTION

PATENT NO. : 4,480,805

DATED : November 6, 1984

INVENTOR(S) : Harold G. Sachleben and Theodore A. Rayman

It is certified that error appears in the above-identified patent and that said Letters Patent are hereby corrected as shown below:

In the claims:

Claim 1, column 3, line 19, after "material" the word --inserted-- should be added.

Signed and Sealed this

*Fourteenth* Day of *May 1985*

[SEAL]

*Attest:*

DONALD J. QUIGG

*Attesting Officer*

*Acting Commissioner of Patents and Trademarks*